US008069526B2

(12) United States Patent
Malaska

(10) Patent No.: US 8,069,526 B2
(45) Date of Patent: Dec. 6, 2011

(54) OVER-THE-HAND CLEANING DEVICE HAVING INDEPENDENTLY-MOVABLE CLEANING TOOL

(76) Inventor: Stephanie N. Malaska, Redmond, WA (US)

( * ) Notice: Subject to any disclaimer, the term of this patent is extended or adjusted under 35 U.S.C. 154(b) by 548 days.

(21) Appl. No.: 12/284,016

(22) Filed: Sep. 17, 2008

(65) Prior Publication Data

US 2010/0064465 A1 Mar. 18, 2010

(51) Int. Cl.
*A47L 13/10* (2006.01)

(52) U.S. Cl. ..... 15/227; 15/118; 15/121; 15/151

(58) Field of Classification Search ..... 15/111, 15/119, 121, 151, 227, 236; 2/160, 161.1, 2/161.6, 163, 16, 20; 294/25; 601/137, 138
See application file for complete search history.

(56) References Cited

U.S. PATENT DOCUMENTS

| | | | | | |
|---|---|---|---|---|---|
| 251,571 | A | * | 12/1881 | Glidden | 30/123.5 |
| 1,530,327 | A | * | 3/1925 | Redlick | 401/7 |
| 1,941,320 | A | * | 12/1933 | Pamplin | 401/7 |
| 1,979,130 | A | * | 10/1934 | Wiley | 2/168 |
| 2,441,908 | A | * | 5/1948 | Schwarzmayr | 119/14.22 |
| 3,593,803 | A | * | 7/1971 | Ibach | 172/10 |
| 4,149,296 | A | * | 4/1979 | Stanford | 452/103 |
| 4,593,427 | A | * | 6/1986 | Ortolivo | 15/227 |
| 4,670,930 | A | | 6/1987 | Lu | |
| 4,867,246 | A | * | 9/1989 | Kiger | 172/370 |
| 4,953,998 | A | * | 9/1990 | McCartherens | 401/7 |
| 4,980,943 | A | | 1/1991 | Barber | |
| 5,373,601 | A | * | 12/1994 | Miller | 15/118 |
| 5,644,796 | A | * | 7/1997 | Laughlin | 2/161.6 |
| 5,673,435 | A | | 10/1997 | Gebhard | |
| 5,740,554 | A | * | 4/1998 | Reed | 2/158 |
| 5,815,840 | A | | 10/1998 | Hamlin | |
| 5,853,210 | A | * | 12/1998 | Robinson | 294/25 |
| 5,926,912 | A | * | 7/1999 | Claphan | 16/411 |
| 6,016,571 | A | * | 1/2000 | Guzman et al. | 2/167 |
| 6,109,214 | A | * | 8/2000 | Rampersad | 119/600 |
| 6,275,995 | B1 | | 8/2001 | LeGette et al. | |
| 6,311,361 | B1 | * | 11/2001 | Cole | 15/227 |
| 6,351,867 | B1 | * | 3/2002 | Forster | 15/121 |
| 6,460,190 | B1 | * | 10/2002 | Blum | 2/158 |
| 6,513,998 | B1 | | 2/2003 | Barry | |
| 6,658,668 | B2 | * | 12/2003 | Newcomb | 2/160 |
| 6,687,942 | B1 | * | 2/2004 | Pember | 15/227 |
| 6,829,802 | B2 | | 12/2004 | McKenzie | |
| 7,210,171 | B2 | * | 5/2007 | Jacobs et al. | 2/160 |
| 7,290,291 | B2 | * | 11/2007 | Anderson et al. | 2/159 |
| 7,350,998 | B2 | * | 4/2008 | Walsh, III | 401/131 |
| 7,363,660 | B1 | * | 4/2008 | Gilliland et al. | 2/161.6 |
| 7,743,690 | B2 | * | 6/2010 | White et al. | 83/13 |
| 7,908,673 | B2 | * | 3/2011 | Kerr-Maddox et al. | 2/163 |
| 2003/0026170 | A1 | * | 2/2003 | Yang | 368/10 |
| 2003/0131430 | A1 | * | 7/2003 | Kajgana | 15/111 |
| 2006/0272116 | A1 | * | 12/2006 | Thompson | 15/227 |
| 2007/0067932 | A1 | | 3/2007 | Young et al. | |
| 2007/0192975 | A1 | | 8/2007 | Aseff | |
| 2007/0277288 | A1 | | 12/2007 | Sing et al. | |
| 2008/0178366 | A1 | | 7/2008 | Daher | |
| 2010/0064465 | A1 | * | 3/2010 | Malaska | 15/227 |

* cited by examiner

*Primary Examiner* — Monica Carter
*Assistant Examiner* — Michael Jennings

(57) ABSTRACT

An over-the-hand cleaning device is described herein that comprises at least one finger portion, a cleaning surface and a rotatable member including at least one cleaning tool.

17 Claims, 2 Drawing Sheets

OVER-THE-HAND CLEANING DEVICE HAVING INDEPENDENTLY-MOVABLE CLEANING TOOL

SUMMARY

An over-the-hand cleaning device is described herein that comprises at least one finger portion, a cleaning surface and a rotatable member including at least one cleaning tool.

An over-the-hand cleaning device is described that comprises at least one finger portion configured to receive and contain at least one finger; a thumb portion configured to receive and contain a thumb, the thumb portion including a thumb nail region; a palm portion integrally formed with the at least one finger portion and the thumb portion, wherein the palm portion is configured to cover the palm of the hand; a cleaning surface secured to at least one of the palm portion and the at least one finger portion; and a rotatable member having at least one independently-movable cleaning tool, wherein the rotatable member is secured to the thumb nail region and is configured to rotate to extendibly dispose at least one of the at least two cleaning tools beyond an edge of the thumb portion. The cleaning device may further comprise at least one squeegee member secured to the at least one finger portion. The cleaning device comprises a cleaning surface secured to the palm portion that is a water-absorbing surface. The cleaning device may include the cleaning surface secured to the palm portion that is a sponge. The cleaning device may include the at least one squeegee member secured to the at least one finger portion that is a composed of an elastomeric material. The cleaning device may include at least two independently-movable cleaning tools including a scraper means. The at least two cleaning tools may include a brush means. The cleaning device may be constructed of a waterproof material. The cleaning device includes the cleaning surface secured to the palm portion that is removably secured to the palm portion.

The summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
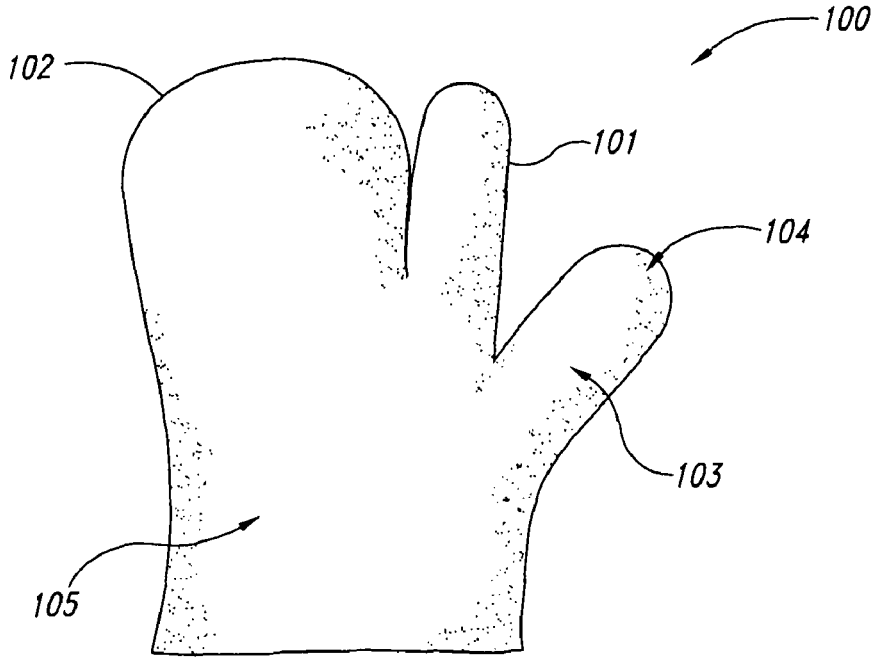
FIG. 1 is a figure of an over the hand cleaning device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to FIG. 1, in an embodiment, an over-the-hand cleaning device 100 comprises at least one finger portion 101 configured to receive and contain at least one finger of a user's hand. The cleaning device 100 may include from one to four finger portions 101 each of which may be configured to receive and contain a finger of the user's hand. When less than four finger portions 101 are utilized, the remaining fingers of the user's hand may be combined into a single finger portion 102 as illustrated in FIG. 1. For example, and without limitation, the cleaning device described herein may have a dedicated finger portion 101 configured to receive and contain the user's index finger, while the remaining fingers of the user's hand may be collectively received and held by a mitten-like finger portion 102. Further still, the index finger and the middle finger may each have dedicated finger portions 101, respectively, while the remaining two fingers are collectively held in a mitten-like finger portion 102.

Referring still to FIG. 1, a thumb portion 103 may be configured to receive and contain a thumb on the user's hand, the thumb portion 103 including a thumbnail region 104. The cleaning device 100 includes a palm region 105 integrally formed with the at least one finger portion 101 and the thumb portion 103.

Figure 2:
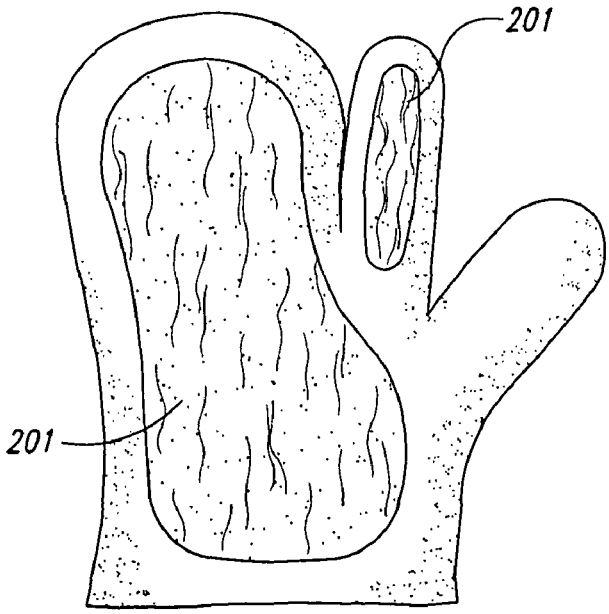
FIG. 2 is a figure of an over the hand cleaning device showing a cleaning surface.

In an embodiment, at least one cleaning surface 201 may be secured to at least a portion of one of the palm region 105 and at least a portion of the at least one finger portion 101 and/or 102. Referring to FIG. 2, the at least one cleaning surface 201 is shown to be secured to a portion of finger portions 101 and 102 and a portion of palm region 105. In a non-limiting embodiment, the at least one cleaning surface 201 may be substantially permanently secured to at least one of the palm portion 105 and the at least one finger portion 101 and/or 102. Substantially permanent securing includes, without limitation, adhesive material such as glue, including cyanoacrylate, epoxy, or another glue material that substantially permanently adheres the at least one cleaning surface 201 to at least one of the palm portion 105 and the at least one finger portion 101 and/or 102; or may include sewing the at least one cleaning surface 201 to the palm portion 105 and or finger portion 101 and/or 102. In a non-limiting embodiment, the at least one cleaning surface 201 may be removably secured to the at least one palm portion 105 and the at least one finger portion 101 and/or 102. Removable securing includes, without limitation, hook and loop material such as Velcro, or may utilize an adhesive tape, or magnetic means.

Figure 3:
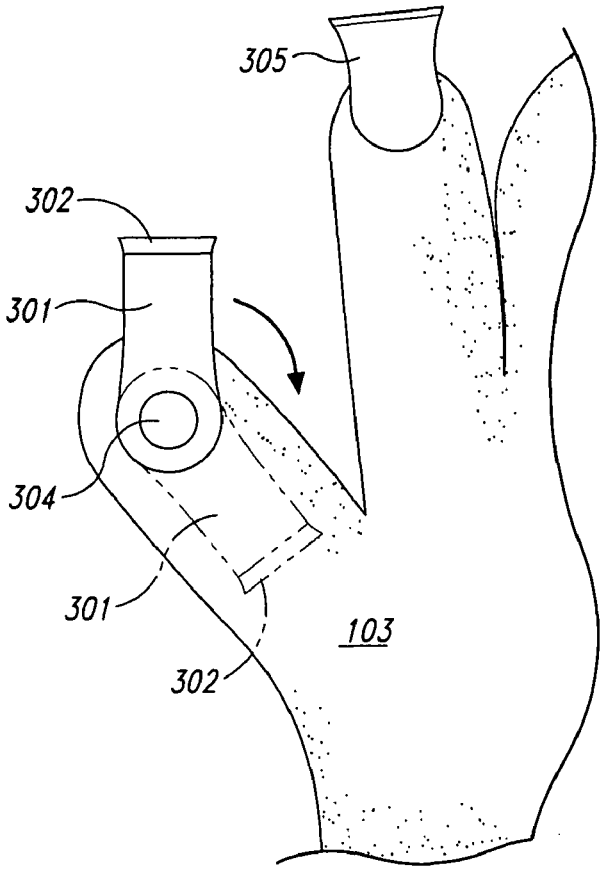
FIG. 3 is a schematic of a finger portion and a thumb portion of the hand cleaning device including devices decried herein.

Referring to FIG. 3, the over-the-hand cleaning device described herein includes a rotatable member 301 that includes at least one cleaning tool 302. The rotatable member 301 may be secured to any finger portion 101 or thumb portion 103. In an embodiment, the rotatable member 301 is secured to the thumbnail region 104 of the thumb portion 103. The rotatable member 301 may be configured to rotate around a pivot point 304 so as to extendibly dispose the at least one cleaning tool 302 beyond an edge of the thumb nail region 104. When the at least one of the cleaning tools 302 is not extended beyond the edge of the thumb nail region 104, it may be securely disposed away from the edge, for example in alignment with the thumb portion, to prevent the tool from interfering with the operation or movement of the thumb portion 103.

The cleaning device described herein may further include at least one squeegee member 305 secured to the at least one finger portion 101. The squeegee member 305 may be secured to the cleaning device by any fastening means, including, but not limited to, adhesive material, hook and loop material, and adhesive tape. The squeegee member includes any semi-rigid material that is configured to scrape or wipe a delicate surface without damaging the surface. A squeegee member includes a flexible rubber, or other synthetic material.

As previously shown in FIG. 2, the cleaning device described herein includes at least one cleaning surface 201 secured to at least a portion of at least one of the palm region 105 and at least a portion of a least one finger portion 101 or 102. The cleaning surface 201 may include at least one of a sponge, cloth, lambs wool, chamois, or any other water-absorbent material. As shown in FIG. 2, an embodiment a cleaning surface includes, for example, a sponge 401. The cleaning surface may cover all or at least a portion of the palm region of the cleaning device, or all or at least a portion of a finger portion.

The cleaning device described herein includes at least one rotatable member secured to at least one finger portion or thumb portion. The rotatable member includes at least one cleaning tool 302, as shown in FIG. 3. The at least one cleaning tool 302 may include, but is not limited to, at least one scraper means, wiping means, cutting means, pick means, or file means. The at least one cleaning tool 302 may include a brush means such as pipe-cleaner type brush, a brush with rubber bristles, or synthetic bristles, or natural bristles. In an embodiment, the cleaning too 302 may include more than one cleaning tool of the same type having varying shapes or sizes.

Figure 4:
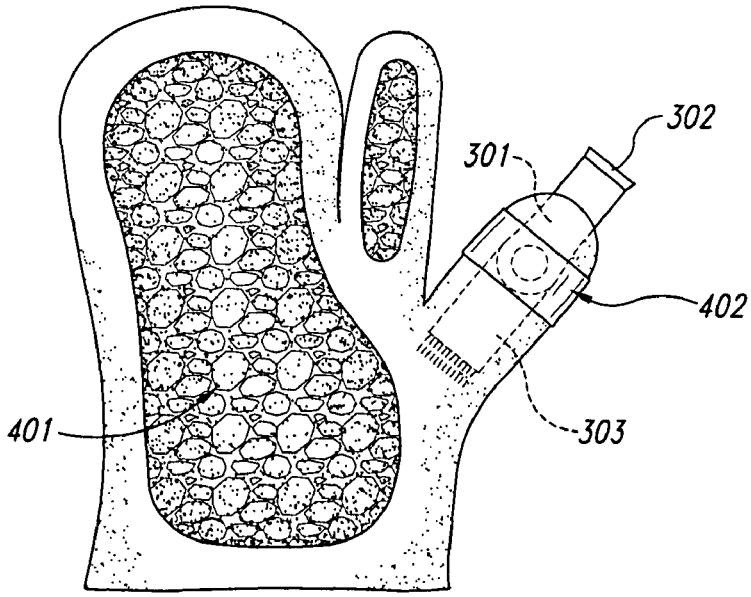
FIG. 4 is a figure of an over the hand cleaning device with examples of various embodiments.

In an embodiment, the rotatable member may be supported by a substantially rigid ring or inner wall contained within the cleaning device. In an embodiment, the substantially rigid ring or support may be configured inside or outside of the thumbnail region 104 of the thumb portion 103 of the cleaning device 100. The ring or support is configured to receive the thumb of the user. The substantially rigid ring or support provides leverage for the at least one cleaning tool 302 when a force is applied to the at least one cleaning tool 302 while in use. Alternatively, the rotatable member 301 may be removable from the cleaning device 100. For example, the rotatable member may be configured with at least a partially tubular body or sleeve to allow the rotatable member to removably slide onto the thumb portion or finger portion of the cleaning device. The rotatable member 301 may be configured to removably attach to the thumb portion 103 or a finger portion 101 or 102 by strap mechanism. In an embodiment, the cleaning device 100 may be configured as a system including the cleaning device 100 and at least one interchangeable rotatable member 301. As shown in FIG. 4, a removable rotatable member 301 may be secured to the thumbnail region 104 of the cleaning device 100 by a strap mechanism 402. In the embodiment shown in FIG. 4, a plurality of removable cleaning tools 302 and 303 may be used interchangeably.

The cleaning device described herein may be constructed of a any material. The cleaning device can be constructed of any suitable material including, for example, cloth fabric, leather, synthetic leather, an elastomeric material, rubber, synthetic rubber, synthetic material, latex, or any combination of the foregoing. In an embodiment the cleaning device described herein may be waterproof to keep the user's hand dry throughout use if water or other liquid is being used.

The device described herein may find many uses, including for example, cleaning the leather tack for horses. Typically, tack must be washed and cleaned after each use to protect and maintain the beauty of the leather material. Leather soap and water are typically used. The device described herein can be used to apply cleaner or conditioner to the tack using the at least one cleaning surface 401 on the at least one of the palm portion and the at least one finger portion of the cleaning device. A squeegee tool located on at least one finger portion may be used to wipe or gently scrape dirt, excess cleaner, conditioner or water from the tack. The rotatable member 301 including at least one cleaning tool 302 may be used to clean small, hard to reach or specific areas of the tack. For example, the brush tool may be used to brush away dirt or debris from hard to reach places in the tack, such as in a seam. As a further non-limiting example, the cleaning tool 302 may include a scraper for gently scraping dirt or debris that is, for example, hard to reach with a conventional tool, or is difficult to remove.

The herein described subject matter may illustrate different components contained within, or connected with, different other components. It is to be understood that such depicted architectures are merely examples, and that, in fact, many other architectures can be implemented that achieve the same functionality. In a conceptual sense, any arrangement of components to achieve the same functionality is effectively associated such that the desired functionality is achieved. Hence, any two components herein combined to achieve a particular functionality can be seen as associated with each other such that the desired functionality is achieved, irrespective of architectures or intermedial components. Likewise, any two components so associated can also be viewed as being operably connected, or operably coupled, to each other to achieve the desired functionality, and any two components capable of being so associated can also be viewed as being operably couplable, to each other to achieve the desired functionality.

While particular aspects of the present subject matter described herein have been shown and described, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. In general, terms used herein, and especially in the appended claims (e.g., bodies of the appended claims), are generally intended as open terms (e.g., the term including should be interpreted as including but not limited to, the term having should be interpreted as having at least, the term includes should be interpreted as includes but is not limited to, etc.). If a specific number of an introduced claim recitation is intended, such an intent will be explicitly recited in the claim, and in the absence of such recitation no such intent is present. For example, as an aid to understanding, the following appended claims may contain usage of the introductory phrases at least one and one or more to introduce claim recitations. However, the use of such phrases should not be construed to imply that the introduction of a claim recitation by the indefinite articles a or an limits any particular claim containing such introduced claim recitation to inventions containing only one such recitation, even when the same claim includes the introductory phrases one or more or at least one and indefinite articles such as a or an (e.g., a and/or an should typically be interpreted to mean at least one or one or more); the same holds true for the use of definite articles used to introduce claim recitations. In addition, even if a specific number of an introduced claim recitation is explicitly recited, such recitation should typically be interpreted to mean at least the recited number (e.g., the bare recitation of two recitations, without other modifiers, typically means at least two recitations, or two or more recitations). Furthermore, in those instances where a convention analogous to at least one of A, B, and C, etc. is used, the convention (e.g., a system having at least one of A, B, and C would include but not be limited to systems that have A alone, B alone, C alone, A and B together, A and C together, B and C together, and/or A, B, and C together, etc.). In those instances where a convention analogous to at least one of A, B, or C, etc. is used, in general such a construction is intended (e.g., a system having at least one of A, B, or C would include but not be limited to systems that have A alone, B alone, C alone, A and B together, A and C together, B and C together, and/or A, B, and C together, etc; or include more than one of any of A, B or C, such as $A_1$, $A_2$ and B, or A, $B_1$, $B_2$, $B_3$ and C, etc.). Virtually any disjunctive word and/or phrase presenting two or more alternative terms, whether in the description, claims, or drawings, should be understood to contemplate the possibilities of including one of the terms, either of the terms, or both terms. For example, the phrase A or B will be understood to include the possibilities of A or B, or A and B.

The various aspects and embodiments disclosed herein are for purposes of illustration and are not intended to be limiting, with the true scope and spirit being indicated by the following claims.

What is claimed is:

1. An over-the-hand cleaning device, comprising:

at least one dedicated finger portion configured to receive and contain at least one finger of a user's hand;

a dedicated thumb portion configured to receive and contain a thumb of the user's hand, the dedicated thumb portion including a thumbnail region;

at least two rotatable members including at least two cleaning tools, wherein the at least two rotatable members is secured to the dedicated thumb portion; and wherein each of the at least two rotatable members is configured to rotate about a pivot point to extendibly dispose one of the at least two cleaning tools beyond the end of the thumb portion, and wherein each of the at least two rotatable members is configured to rotate about the pivot point to dispose at least one of the at least two cleaning tools away from the end of, and in a position of alignment with, the dedicated thumb portion;

a palm region integrally formed with the at least one dedicated finger portion and the dedicated thumb portion, wherein the palm region is configured to receive, contain and cover at least a portion of the palm of the user's hand; and at least one cleaning surface secured to the exterior of at least one of at least a portion of the palm region and at least a portion of the at least one dedicated finger portion for contacting a surface to be cleaned.

2. The over-the-hand cleaning device of claim 1, wherein the at least two rotatable members are secured to the thumbnail region of the thumb portion.

3. The over-the-hand cleaning device of claim 1, further comprising: at least one squeegee member secured to the at least one finger portion.

4. The over-the-hand cleaning device of claim 1, wherein the cleaning surface secured to the palm portion includes a liquid-absorbent surface.

5. The over-the-hand cleaning device of claim 4, wherein the cleaning surface secured to the palm portion includes a sponge.

6. The over-the-hand cleaning device of claim 4, wherein the cleaning surface secured to the palm portion includes lamb's wool.

7. The over-the-hand cleaning device of claim 1, wherein the at least two cleaning tools includes a scraper means.

8. The over-the-hand cleaning device of claim 1, wherein the at least two cleaning tools includes a brush means.

9. The over-the-hand cleaning device of claim 1, wherein the at least one dedicated finger portion configured to receive and contain at least one finger of a user's hand comprises a first dedicated finger portion and a second dedicated finger portion, the first dedicated finger portion configured to receive and contain an index finger on the hand of a user, and the second dedicated finger portion configured to receive and contain at least two fingers on the hand of the user.

10. An over-the-hand cleaning system, comprising:

a glove, including at least one dedicated finger portion configured to receive and contain at least one finger of a user's hand;

a dedicated thumb portion configured to receive and contain a thumb of the user's hand; and at least two rotatable members including at least one two cleaning tools, wherein each of the at least two rotatable members is configured to be removably secured to the dedicated thumb portion and the at least one finger portion; and wherein each of the at least two rotatable members is configured to rotate about a pivot point to extendibly dispose one of the at least one two cleaning tools;

a palm portion integrally formed with the at least one dedicated finger portion and the dedicated thumb portion, wherein the palm portion is configured to cover at least a portion of the palm of the user's hand; at least one cleaning surface secured to at least one of the palm portion and the at least one dedicated finger portion for contacting a surface to be cleaned.

11. The over-the-hand cleaning system of claim 10, further comprising: at least one squeegee member secured to the at least one finger portion.

12. The over-the-hand cleaning system of claim 10, wherein the cleaning surface secured to the palm portion is a liquid-absorbent surface.

13. The over-the-hand cleaning system of claim 12, wherein the cleaning surface secured to the palm portion is a sponge.

14. The over-the-hand cleaning system of claim 12, wherein the cleaning surface secured to the palm portion is lamb's wool.

15. The over-the-hand cleaning system of claim 10, wherein the at least two cleaning tools includes a scraper means.

16. The over-the-hand cleaning system of claim 10, wherein the at least two cleaning tools includes a brush means.

17. The over-the-hand cleaning system of claim 10, wherein the at least one dedicated finger portion configured to receive and contain at least one finger comprises a first dedicated finger portion and a second dedicated finger portion, the first dedicated finger portion configured to receive and contain an index finger on the hand of a user, and the second dedicated finger portion configured to receive and contain at least two fingers on the hand of the user.

* * * * *